US005269960A

United States Patent [19]

Gray et al.

[11] Patent Number: 5,269,960

[45] Date of Patent: Dec. 14, 1993

[54] STABLE LIQUID AQUEOUS ENZYME DETERGENT

[75] Inventors: Robert L. Gray, Oakley; Robert L. Tucker, Livermore; Gregory van Buskirk, Danville; Paul K. Anderson, Dublin, all of Calif.

[73] Assignee: The Clorox Company, Oakland, Calif.

[21] Appl. No.: 562,099

[22] Filed: Aug. 2, 1990

Related U.S. Application Data

[63] Continuation of Ser. No. 251,717, Sep. 25, 1988, abandoned.

[51] Int. Cl.[5] ..... C11D 7/42; C11D 3/386

[52] U.S. Cl. ..... 252/174.12; 252/DIG. 12; 252/173; 252/174.21

[58] Field of Search ..... 252/8.75, 106, 114, 252/122, 132, 153, 527, 540, 541, 174.12, DIG. 12

[56] References Cited

U.S. PATENT DOCUMENTS

| | | | |
|---|---|---|---|
| 3,600,318 | 2/1982 | Mast | 252/99 |
| 3,676,374 | 7/1972 | Zaki et al. | 252/551 |
| 3,682,842 | 8/1972 | Innerfield | 252/539 |
| 3,717,550 | 2/1973 | Ziffer | 195/63 |
| 3,819,528 | 6/1974 | Berry | 252/153 |
| 3,953,380 | 4/1976 | Sundby | 252/543 |
| 3,985,687 | 10/1976 | Inamorato et al. | 252/551 |
| 4,092,273 | 5/1978 | Inamorato et al. | 252/548 |
| 4,101,457 | 7/1978 | Place et al. | 252/559 |
| 4,111,855 | 9/1978 | Barrat | 252/545 |
| 4,222,905 | 9/1980 | Cockrell | 252/547 |
| 4,228,042 | 10/1980 | Letton | 252/528 |
| 4,228,044 | 10/1980 | Cambre | 152/547 |
| 4,243,543 | 1/1981 | Guilbert et al. | 252/105 |
| 4,243,546 | 1/1981 | Shaer | 252/174.12 |
| 4,244,840 | 1/1981 | Straw | 252/540 |
| 4,247,425 | 1/1981 | Egan et al. | 252/548 |
| 4,260,529 | 4/1981 | Letton | 252/547 |
| 4,264,457 | 4/1981 | Beeks et al. | 252/875 |
| 4,285,841 | 8/1981 | Barrat et al. | 252/559 |
| 4,287,082 | 9/1981 | Tolfo et al. | 252/174.12 |
| 4,305,837 | 12/1981 | Kaminsky et al. | 252/714.12 |
| 4,316,824 | 2/1982 | Pancheri | 252/551 |
| 4,318,818 | 3/1982 | Letton et al. | 252/174.12 |
| 4,368,147 | 1/1983 | Inamorato et al. | 252/545 |
| 4,391,745 | 7/1983 | Denkler et al. | 252/554 |
| 4,490,285 | 12/1984 | Kebanli | 252/551 |
| 4,492,646 | 1/1985 | Welch | 252/528 |
| 4,507,219 | 3/1985 | Hughes | 252/118 |
| 4,537,707 | 8/1985 | Severson, Jr. | 252/545 |
| 4,561,998 | 12/1985 | Wertz et al. | 252/547 |
| 4,576,729 | 3/1986 | Paszek et al. | 252/106 |
| 4,581,161 | 4/1986 | Nedonchelle | 252/550 |
| 4,608,189 | 8/1986 | Koch et al. | 252/174.22 |
| 4,671,895 | 6/1987 | Erilli et al. | 252/552 |
| 4,692,260 | 9/1987 | Sung et al. | 252/99 |
| 4,692,275 | 9/1987 | Secemski et al. | 252/534 |
| 4,715,990 | 12/1987 | Crossin et al. | 252/551 |
| 4,717,507 | 1/1988 | Schwadtke et al. | 252/548 |
| 4,747,977 | 5/1988 | Whitehead et al. | 252/111 |

FOREIGN PATENT DOCUMENTS

| | | |
|---|---|---|
| 0118933 | 9/1984 | European Pat. Off. . |
| 137616 | 4/1985 | European Pat. Off. . |
| 189225 | 7/1986 | European Pat. Off. . |
| 399752 | 11/1990 | European Pat. Off. . |
| 3320340 | 12/1983 | Fed. Rep. of Germany . |
| 2173224 | 10/1886 | United Kingdom . |
| 2194956 | 3/1988 | United Kingdom . |
| 2206602 | 1/1989 | United Kingdom . |

*Primary Examiner*—Ellen M. McAvoy

*Attorney, Agent, or Firm*—Joel J. Hayashida; Michael J. Mazza; Harry A. Pacini

[57] ABSTRACT

The present invention provides a stable liquid, aqueous enzyme detergent comprising a mixture of nonionic and anionic surfactants, enzymes and a calcium ion source as an enzyme stabilizer, wherein phase instability is prevented by the use of an alkyl ether carboxylate as a phase stabilizer. This material also surprisingly enhances enzyme stability and imparts additional detergency performance to the liquid detergents. Standard adjuncts may be added to the compositions of this invention.

14 Claims, No Drawings

STABLE LIQUID AQUEOUS ENZYME DETERGENT

This application is a continuation of application Ser. No. 07/251,717, filed Sep. 25, 1988, now abandoned.

BACKGROUND OF THE INVENTION

1. Field of the Invention

This invention relates to phase stable, liquid aqueous enzyme-containing detergents, which have enhanced physical stability and improved enzyme stability.

2. Brief Description of the Prior Art

Liquid detergents are desirable alternatives to dry, granular detergent products. While dry, granular detergents have found wide consumer acceptance, liquid products can be adapted to a wide variety of uses. For example, liquid products can be directly applied to stains and dirty spots on fabrics, without being predissolved in water or other fluid media. Further, a "stream" of liquid detergent can be more easily directed to a targeted location in the wash water or clothing than a dry, granular product.

There have been many attempts to formulate liquid, aqueous detergents which include enzymes. Enzymes are very desirable adjuncts in liquid detergents since they are effective at removing stains which may not be cleaned through detergent or oxidative action. These problematic stains include grass stains and blood stains, which typically are complex mixtures of various substances such as proteins, fats, and natural coloring agents.

Attempts to compatibilize enzymes in these liquid, aqueous detergents, however, can lead to further problems, namely resulting physical instability. Many materials which act as enzyme stabilizers are insoluble in, or incompatible with, other components which make up typical liquid detergents.

Letton et al., U.S. Pat. No. 4,318,818, discloses a stable aqueous enzyme composition consisting of surfactants, pure enzyme, alcohol solvents, a lower carboxylate, a soluble calcium salt in an amount such that no more than 0.1–10 millimoles of calcium ion per liter are present, with the additional provisos that the pH is 6.5–10, but when the pH is 8.5 or less, only 2 millimoles of calcium per liter/water are present, and when the pH is greater than 8.5, the carboxylate must be a formate. Apparently, Letton recognizes that at low pH, the amount of calcium used as an enzyme stabilizer must be limited to very low amounts, or physical stability may be affected.

Kaminsky et al., U.S. Pat. No. 4,305,837, discloses stabilized aqueous liquid detergents containing surfactants, protease, alcohols, 3–10% of a water soluble formate, a soluble calcium salt which imparts 2–10 millimoles of calcium ion per liter, triethanolamine and water. Kaminsky concerns itself primarily with enzyme stability, and teaches that triethanolamine can be used for both enzyme stability and as a pH adjusting agent, which apparently buffers an aqueous solution to a pH of about 8.5–10.

Tolfo et al., U.S. Pat. No. 4,287,082, discloses a homogenous liquid detergent consisting essentially of a surfactant, a $C_{12-14}$ saturated fatty acid, enzyme, a lower carboxylate selected from acetic acid, formic acid and sodium formate, and 0.5–1.5 millimoles of calcium ion per liter, in which the pH is 6.5–8.5. Tolfo, similar to its brethren patents, Kaminsky and Letton, above, discloses that very small, discrete amounts of calcium ion should be present in these liquid compositions in order to stabilize the enzymes.

In each of the above three references, the amount of calcium ion present must be rigorously limited. The explanation for this is that high amounts of calcium can be precipitated by anionic surfactants which may be present in the liquid compositions. Note, for instance, that Tolfo, which specifically recites the presence of saturated fatty acid, has the lowest amount of calcium ion present, namely, 0.5–1.5 millimoles.

Severson, U.S. Pat. No. 4,537,707, discloses a liquid detergent containing anionic surfactants, fatty acids, builders, protease, boric acid, water-soluble formate, 1–30 millimoles of calcium ion/liter and water. Severson teaches a boric acid/formate complex ". . . which effectively cross-link[s] or staple[s] an enzyme molecule together, thereby holding it in its active spatial confirmation." (Column 2, Lines 51–53). Thus, Severson focuses on enzyme stability by the use of a boric acid/calcium/formate complex.

Hughes, U.S. Pat. No. 4,507,219, discloses a liquid detergent containing an alkyl or alkenyl sulfonate, an alkyl ethoxylated sulfate, a nonionic surfactant, a mixed $C_{10-14}$ saturated fatty acid, a water soluble polycarboxylate builder, a source of potassium and sodium ions in a molar ratio of 0.1:1.3 K:Na, ethanol, polyol and water. The invention claimed by Hughes is an unusual neutralization system comprising mixed potassium and sodium ions, which are necessary to maintain the homogeneity of the polycarboxylates in the aqueous dispersion. Thus, Hughes contemplates a complex system where a specific builder is maintained in solution by means of an involved neutralization procedure.

Barrat, U.S. Pat. No. 4,111,855, discloses liquid detergents in which a polyacid and a source of calcium ions forms water-soluble calcium complexes in order to enhance enzyme stability. Thus, this reference contemplates the use of polycarboxylic acids in conjunction with calcium ions solely for enzyme stability.

Inamorato et al., U.S. Pat. No. 4,368,147, discloses a liquid detergent consisting essentially of $C_{10-18}$ alkoxylated nonionic surfactant, having 2–3 moles of alkoxy per mole of alcohol, a $C_{2-3}$ alcohol, a sodium or potassium formate as a viscosity control and gel preventer, and the balance, water. This particular patent does not employ enzymes, and thus avoids problems introduced when enzyme stabilizers, such as calcium salts, are added to liquid detergents.

Kebanli, U.S. Pat. No. 4,490,285, discloses a nonionic surfactant, $C_{10-18}$ alcohol ethoxysulfate, which is apparently monoethoxylated, and the ratio of nonionic:alcohol ethoxysulfate is about 2:1 to 4:1, and a solvent system comprising water or mixtures thereof with $C_{1-6}$ alcohol. This patent is restricted to the use of an alcohol monoethoxysulfate. The inventions claimed in Kebanli are contended to be superior in detergency over polyethoxylated sulfates.

Review of the foregoing prior art reveals that none of these references disclose, teach or suggest that alkyl ether carboxylates are effective phase stabilizers for liquid detergents containing enzymes stabilized by calcium ions. The prior references all focus on individual problems in the field. Thus, most of the references discuss enzyme stability in a liquid system (Letton, Tolfo, Kaminsky, Severson, Barrat), while others concern themselves with stabilization of the various, somewhat incompatible materials in the liquid system (Inamorato, Hughes), while still others focus on materials which assertedly impart improved detergency (Kebanli). None of the foregoing references seeks to achieve both good phase stability and enzyme stability of liquid detergents by the use of effective amounts of alkyl ether carboxylates.

SUMMARY OF THE INVENTION AND OBJECTS

The invention provides, in a first embodiment, a stable liquid, aqueous enzyme detergent comprising, by weight percent:

a) 5–65% of an alkoxylated alcohol nonionic surfactant;
b) 0–30% of an alkyl ether sulfate;
c) 0.5–30% of an alkyl ether carboxylate phase stabilizer;
d) less than 5% of an unsaturated $C_{6-20}$ fatty acid foam controller;
e) about 0–25% of a lower alkanol, glycol, or alkylene glycol solvent;
f) about 0.01–5% of a hydrolase enzyme;
g) about 0.01–1% of an enzyme stabilizing calcium salt; and
h) the balance, water.

In another embodiment of the invention is provided a phase stable liquid, aqueous enzyme detergent which maintains phase stability at prolonged storage and elevated temperatures, comprising:

a) at least 5% of a nonionic surfactant having an HLB of 10–16 and a pour point less than about 40° C.;
b) at least 1% of a $C_{10-16}$ alkyl ether sulfate, which contains 1–5 moles of ethylene oxide per mole of alcohol;
c) at least 0.5% of a $C_{8-18}$ alkyl ether carboxylate, which contains 1–20 moles of ethylene oxide per mole of alcohol, said compound used as a phase stabilizer;
d) at least 0.1%, but not greater than 5%, of an unsaturated $C_{10-20}$ fatty acid or salt thereof, which is used as a foam controller;
e) a mixture of a lower alkanol solvent with a lower glycol, said solvents in a ratio of about 10:1 to 1:10;
f) at least 0.01% of a protease, an amylase, or a mixture thereof;
g) at least 0.01 of a soluble calcium salt which effectively stabilizes against enzyme deactivation; and
h) the balance, water.

It is an object of the present invention to physically stabilize a liquid, aqueous detergent comprising anionic and nonionic surfactants with enzymes and a calcium ion stabilizer by the introduction of a phase stabilizing amount of an alkyl ether carboxylate.

It is a further object of this invention to provide a liquid, aqueous detergent comprising anionic and nonionic surfactants, an enzyme, a stabilizer therefor, and a foam controlling agent, in which gellation does not occur.

It is a still further object of this invention to use a phase stabilizer which is not deleterious to enzyme stability.

It is also an object of this invention to disperse an enzyme which is chemically and physically stable in a liquid detergent comprising anionic and nonionic surfactants, but whose enzyme stabilizer does not deleteriously impact phase stability of the detergent.

DETAILED DESCRIPTION OF THE PREFERRED EMBODIMENTS

The present invention provides a phase stable, liquid aqueous enzyme detergent, in which the enzyme's activity is maintained stable through the use of a calcium ion stabilizer, in relatively high amounts, but which enzyme stabilizer does not deleteriously affect the physical stability of the liquid detergent. This is the result of the use of an alkyl ether carboxylate phase stabilizer. The stabilities of these liquid detergents are quite surprising, since review of prior references shows that lower carboxylates in relatively low amounts can act as enzyme stabilizers, but such references also teach that high amounts of an inexpensive enzyme stabilizer, calcium, should be avoided in order to prevent compromising physical stability since calcium can precipitate with anionic materials present in the detergents. Surprisingly, an alkyl ether carboxylate effectively disperses the various components of the inventive liquid detergents without compromising the enzymatic activity of the enzymes therein.

In the present invention, a liquid, aqueous detergent is specially formulated to contain nonionic and anionic surfactants, enzymes and an enzyme stabilizer comprising relatively high amounts of calcium ion, but in which phase separation is prevented by the use of an alkyl ether carboxylate. Separation into various layers is disadvantageous to liquid detergents, since various cleaning actives will then be separated from one another, and complete cleaning may not result. Further, phase instability results in an aesthetically unattractive product.

The alkyl ether carboxylate stabilizer of the present invention overcomes these problems. In the following description, the components of the invention are described.

1. Nonionic Surfactants

The nonionic surfactants present in the invention will preferably have a pour point of less than 40° C., more preferably less than 35° C., and most preferably below about 30° C. They will have an HLB (hydrophile-lipophile balance) of between 2 and 16, more preferably between 4 and 15, and most preferably between 10 and 14. However, mixtures of lower HLB surfactants with higher HLB surfactants can be present, the resulting HLB usually being an average of the two or more surfactants. Additionally, the pour points of the mixtures can be, but are not necessarily, weighted averages of the surfactants used.

The nonionic surfactants are preferably selected from the group consisting of $C_{6-18}$ alcohols with 1–15 moles of ethylene oxide per mole of alcohol, $C_{6-18}$ alcohols with 1–10 moles of propylene oxide per mole of alcohol, $C_{6-18}$ alcohols with 1–15 moles of ethylene oxide and 1–10 moles of propylene oxide per mole of alcohol, $C_{6-18}$ alkylphenols with 1–15 moles of ethylene oxide or propylene oxide or both, and mixtures of any of the foregoing. Certain suitable surfactants are available from Shell Chemical Company under the trademark Neodol. Suitable surfactants include Neodol 25-9 ($C_{12-15}$ alcohol with an average 9 moles of ethylene oxide per mole of alcohol). Another suitable surfactant may be Alfonic 1218-70, which is a $C_{12-18}$ alcohol, which is ethoxylated with about 10.7 moles of ethylene oxide per mole of alcohol, from Vista Chemical, Inc. These and other nonionic surfactants used in the invention can be either linear or branched, or primary or secondary alcohols. If surfactants used are partially unsaturated, they can vary from $C_{10-22}$ alkoxylated alcohols, with a minimum iodine value of at least 40, such as exemplified by Drozd et al., U.S. Pat. No. 4,668,423, incorporated herein by reference. An example of an ethoxylated, propoxylated alcohol is Surfonic JL-80X ($C_{9-11}$ alcohol with about 9 moles of ethylene oxide and 1.5 moles of propylene oxide per mole of alcohol), available from Texaco Chemical Company.

Other suitable nonionic surfactants may include polyoxyethylene carboxylic acid esters, fatty acid glycerol esters, fatty acid and ethoxylated fatty acid alkanolamides, certain block copolymers of propylene oxide and ethylene oxide and block polymers of propylene oxide and ethylene oxide with a propoxylated ethylene diamine (or some other suitable initiator). Still further, such semi-polar nonionic surfactants as amine oxides, phosphine oxides, sulfoxides and their ethoxylated derivatives, may be suitable for use herein.

Nonionic surfactants are especially preferred for use in this invention since they are generally found in liquid form, usually contain 100% active content, and are particularly effective at removing oily soils, such as sebum and glycerides. The nonionic surfactant should be present in the liquid detergent at about 5–65%, more preferably 15–45%, and most preferably 25–40%, by weight of the composition. It is actually most preferred to have the surfactant system include about at least 50% nonionic surfactant. The ratio of the surfactants should be, preferably, about 10:1 to 1:1, nonionic to anionic surfactants, more preferably 4:1 to 1:1. The resulting liquid composition should preferably have a viscosity of about 1–5,000 centipoises (CPS), more preferably 5–3,000 CPS, and most preferably about 10–1,500 CPS.

2. Anionic Surfactants

One of the three anionic surfactants used herein is an alkyl ether sulfate. The other two are the alkyl ether carboxylate phase stabilizer, and an unsaturated fatty acid. However, the latter two materials are utilized in their roles as, respectively, phase stabilizers and foam controllers.

The alkyl ether sulfates are also known as alcohol alkoxysulfate anionic surfactants. These types of surfactants have the following structure:

$$R-(-O-CH_2CH_2-)_nSO_4M$$

wherein R is a $C_{10-16}$ alkyl, and n is an integer from about 1–5, and M is H or an alkali metal cation (sodium, potassium or lithium).

These alkyl ether sulfates are manufactured by condensing a fatty alcohol with ethylene oxide and sulfonating the resulting product. This is then neutralized with an appropriate base. Normally, it is typical to calculate the amount of surfactant on a non-neutralized or acid basis. Some ethanol or other solvent may be present in the commercial surfactant as a carrier. In the present invention, it is preferred to have about 0–30% of the alkoxylated, sulfated fatty alcohol, more preferably 2–25%, and most preferably 5–20% thereof.

3. Alkyl Ether Carboxylate Phase Stabilizer

The alkyl ether carboxylate (also known as an alcohol alkoxycarboxylate) is preferably a $C_{8-18}$, more preferably $C_{10-16}$, and most preferably $C_{12-14}$, fatty alcohol, which has been ethoxylated with an average of about 1–20, more preferably 2–15, and most preferably 3–10 moles of ethylene oxide per mole of alcohol, and subsequently carboxylated. They are also known as carboxylated fatty alcohol ethoxylates. It is preferred that if a mixture of fatty alcohols is used, that the higher molecular weight portions (i.e., $C_{14}$ and greater) are present in lesser amounts, although higher alkyl ether carboxylates may be utilized by having higher amounts of ethylene oxide to aid in dispersing the compound in aqueous solution. The use of the carboxylated, fatty alcohol ethoxylate phase stabilizer is preferred since, unlike other anionic surfactants, e.g., alkyl benzene sulfonate (LAS), there are less deleterious effects on enzymes. More importantly, unlike regular fatty acid soaps or LAS, phase instability because of co-precipitation with the calcium salts is avoided. This discovery was especially surprising since the distinction, in this context, between alkyl ether carboxylates and normal soaps was heretofore unknown. For example, Severson, U.S. Pat. No. 4,537,707, appears to suggest that long chain carboxylates (i.e., fatty acid soaps) can be ethoxylated in the hydrocarbon chain. This, however, results in an ethoxylated fatty acid, with the structure $$R-\overset{\overset{\displaystyle O}{\|}}{C}-O(-CH_2CH_2O)_n-H.$$

This is in direct contrast to the alkyl ether carboxylates, which have the structure $$R-O(CH_2CH_2O)_x-CH_2-\overset{\overset{\displaystyle O}{\|}}{C}OH$$

and are not derived from fatty acids, but rather, from fatty alcohols. These compounds are manufactured by ethoxylating fatty alcohols in the presence of a suitable catalyst, and then introducing a carboxyl group by reacting with, e.g., chloroacetic acid. In addition, the alkyl ether carboxylates are formally denoted anionic surfactants bearing little physical properties similar to fatty acids, or ethoxylated fatty acids (which are actually considered nonionic surfactants).

An especially preferred alkyl ether carboxylate is Sandopan DTC, a $C_{13}$ fatty alcohol carboxylate with an average 7 moles of ethylene oxide per mole of alcohol, which is available from Sandoz Chemicals. See also, Beeks et. al., U.S. Pat. No. 4,264,479, and Paszek et al., U.S. Pat. No. 4,576,729, both of which are incorporated herein by reference. Both Beeks and Paszek desire the use of apparent alkyl ether carboxylates in systems containing cationic surfactants, which are avoided in this invention. The use of this phase stabilizer in the invention has dramatically improved phase stability over the use of none. Also, it has been determined that there is apparently a critical lower level of alkyl ether carboxylate which must be present in order to provide phase stability in the systems. For instance, when certain nonionic surfactants are in the liquid detergent, using less than 1% of the alkyl ether carboxylate as the sole phase stabilizer can result in the formation of a precipitate when the relatively high amounts of calcium ion used as a stabilizer for the enzyme are present in the liquid detergent. Moreover, and also just as surprisingly, use of the alkyl ether carboxylates results in significantly better enzyme stability as compared to the use of another anionic surfactant, LAS. It is preferred to include about 1–30% of the alkyl ether carboxylate in the liquid composition, more preferably about 2-25%, and most preferably, about 4-10%. It is also preferred to add a co-stabilizer, such as $C_{1-3}$ carboxylate, as discussed below in 9. Additionally, if the nonionic surfactant used has a chain length of $C_{11}$ or less, as little as 0.50% alkyl ether carboxylate can stabilize the detergent. On the other hand, when the nonionic surfactant is $C_{12}$ or greater, it has been observed that it is preferred to use greater than about 1% alkyl ether carboxylate.

4. Unsaturated Fatty Acid Foam Controller

Although in typical liquid and dry detergent applications, alkylpolysiloxanes, such as dimethylpolysiloxane, have been used as anti-foaming agents, such agents may not be optimal for use in the present invention since they provide little, if any, cleaning performance. It has been found that unsaturated fatty acids in relatively low amounts are effective as foam-controlling agents. Additionally, these materials are relatively soluble and thus dispersed very well in the inventive liquid detergent. In the present application, it is preferred that less than 5% of this unsaturated $C_{6-20}$ fatty acid be present, more preferably less than 4%, and most preferably less than 3%. This lower level appears crucial, since phase instability has been noted to occur at higher levels. Also, it is crucial to avoid saturated fatty acids, even such moderate length soaps, such as lauric acid, since they cause a visible precipitation of the present invention. Even as little as 1% saturated fatty acid can cause a precipitate to form. An especially preferred fatty acid is oleic acid.

5. Solvent

A lower alkanol, i.e., a $C_{1-4}$ alcohol, is used in the present invention to enhance the dispersibility of the composition and possibly, to thin a relatively viscous formulation. Ethanol and propanol are preferred, with ethanol being most preferred. 0-25% of the alkanol is present, more preferably 1-20%, and most preferably 1-15%.

A further solvent may also be substituted for the alkanol, or combined with the alkanol, and added to the present invention. These are selected from $C_{2-6}$ glycols and glycol ethers. Examples of such glycols include ethylene glycol and propylene glycol, and an exemplary glycol ether is 2-butoxyethanol (also called butyl Cellosolve, available from Union Carbide). If both solvents, i.e., alkanol and either glycol or glycol ether, are present, it is preferred that they be in a ratio of about 10:1 to 1:10, more preferably about 3:1 to 1:3, and most preferably about 1:1. Propylene glycol is especially preferred, because of the added phase stability it produces, as well as enhanced rinsability of the liquid detergent.

6. Hydrolase

Enzymes are especially desirable adjunct materials in these liquid detergents. However, in order to maintain the activity of these enzymes in these aqueous detergents, it is necessary that a calcium ion source be present. This is because water has been demonstrated to mediate enzyme decomposition, denaturation, or the like.

Proteases are one especially preferred class of enzymes. They are selected from acidic, neutral and alkaline proteases. The terms "acidic," "neutral," and "alkaline," refer to the pH at which the enzymes' activity are optimal. Examples of neutral proteases include Milezyme (available from Miles Laboratory) and trypsin, a naturally occurring Protease. Alkaline proteases are available from a wide variety of sources, and are typically produced from various microorganisms (e.g., *Bacillis subtilisin*). Typical examples of alkaline proteases include Maxatase and Maxacal from International BioSynthetics, Alcalase, Savinase and Esperase, all available from Novo Industri A/S. See also Stanislowski et al., U.S. Pat. No. 4,511,490, incorporated herein by reference.

Further suitable enzymes are amylases, which are carbohydrate-hydrolyzing enzymes. It is also preferred to include mixtures of amylases and proteases. Suitable amylases include Rapidase, from Societe Rapidase, Milezyme from Miles Laboratory, and Maxamyl from International BioSynthetics.

Still other suitable enzymes are cellulases, such as those described in Tai, U.S. Pat. No. 4,479,881, Murata et al., U.S. Pat. No. 4,443,355, Barbesgaard et al., U.S. Pat. No. 4,435,307, and Ohya et al., U.S. Pat. No. 3,983,082, incorporated herein by reference.

Yet other suitable enzymes are lipases, such as those described in Silver, U.S. Pat. No. 3,950,277, and Thom et al., U.S. Pat. No. 4,707,291, incorporated herein by reference.

The hydrolytic enzyme should be present in an amount of about 0.01-5%, more preferably about 0.01-3%, and most preferably about 0.1-2% by weight of the detergent. Mixtures of any of the foregoing hydrolases are desirable, especially protease/amylase blends.

7. Calcium Salt Enzyme Stabilizer

The present invention requires that an enzyme stabilizer be present to prevent substantial deactivation or denaturation of the enzymes in the aqueous phase of the liquid detergent. Thus, water-soluble calcium salts, which can provide calcium ions are suitable for use herein. Thus, any water-soluble calcium salt able to provide available calcium ions in aqueous solution is suitable. Examples of such sources of calcium ions include, but are not limited to, calcium chloride, calcium acetate, calcium propionate and calcium formate. It is not exactly understood why calcium ions help to stabilize enzymes against deactivation. However, unlike the prior art, surprisingly much higher amounts of calcium salt can be present, and still maintain good phase stability. In the present invention, it is preferred that about 0.01-1%, more preferably 0.01-0.5%, and most preferably about 0.05-0.5%, calcium ion be present in the liquid detergent.

8. pH

The present invention is preferably near neutral. Thus, in contrast to most dry, granular detergents, the pH is somewhat more acidic. Thus, the pH of the invention varies from about 6-9, more preferably between 6-8 and most preferably, no more than about 8. In order to attain the pH, the pH can be adjusted by the use of various buffers. A large number of the materials added to these aqueous detergents are acidic in nature, such as the alkyl ether sulfate, the alkyl ether carboxylate, and the unsaturated fatty acids. Additionally, discussed in 9 below, additional stabilizers are selected from short chain carboxylic acids. Therefore, buffers and pH-adjusting agents, such as sodium hydroxide, and sodium bicarbonate can be used to modify the pH. In the event that more acidity is desired, hydrochloric acid, sulfuric acid, and citric acid would be suitable for maintaining or adjusting to a more acidic pH.

9. Additional Phase Stabilizers

Additionally desirable phase stabilizers are water soluble short chain carboxylic acids, and the salts thereof. These include acetic acid, formic acid and propionic acid, and their alkali metal and ammonium salts. Sodium chloride and other water soluble chlorides can also be used. It is preferred that these particular types of salts vary from about 1-15%, more preferably about 1-10%, and most preferably about 1-7.5% by weight of the composition. Sodium acetate is especially preferred for use here. When these short chain carboxylates are added, the minimum phase stabilizing amount of the fatty alcohol carboxylate is actually lowered. These salts differ from the calcium salts in 7. (above) used as enzyme stabilizers.

10. Adjuncts

The standard detergent adjuncts can be included in the present invention. These include dyes, such as Monastral blue and anthraquinone dyes (such as those described in Zielske, U.S. Pat. No. 4,661,293, and U.S. Pat. No. 4,746,461). Pigments, which are also suitable colorants, can be selected, without limitation, from titanium dioxide, ultramarine blue (see also, Chang et al., U.S. Pat. No. 4,708,816), and colored aluminosilicates. Fluorescent whitening agents are still other desirable adjuncts. These include the stilbene, styrene, and naphthalene derivatives, which upon being impinged by visible light, emit or fluoresce light at a different wavelength. These FWA's or brighteners are useful for improving the appearance of fabrics which have become dingy through repeated soilings and washings. Preferred FWA's are Tinopal CBS-X and Tinopal RBS, both from Ciba Geigy A.G., and Phorwhite BBH, from Mobay Chemicals. Examples of suitable FWA's can be found in U.S. Pat. Nos. 1,298,577, 2,076,011, 2,026,054, 2,026,566, 1,393,042; and U.S. Pat. Nos. 3,951,960, 4,298,290, 3,993,659, 3,980,713 and 3,627,758, incorporated herein by reference. Anti-redeposition agents, such as carboxymethylcellulose, are potentially desirable. Next, foam boosters, such as appropriate anionic surfactants, may be appropriate for inclusion herein. Also, in the case of excess foaming resulting from the use of certain nonionic surfactants, further anti-foaming agents, such as alkylated polysiloxanes, e.g., dimethylpolysiloxane, would be desirable. Next, bleach activators could well be very desirable for inclusion herein and a liquid oxidant, specifically hydrogen peroxide. Suitable examples of appropriate bleach activators may be found in Mitchell et al., U.S. Pat. No. 4,772,290. Mitchell may be especially appropriate since it describes stable activators in an aqueous liquid hydrogen peroxide composition and it is incorporated herein by reference. In this detergent matrix, it may also be desirable to stabilize the liquid hydrogen peroxide against decomposition. Thus, stabilizers therefor may be appropriate, such as those disclosed in Baker et al., U.S. Pat. No. 4,764,302, and in Mitchell et al., published European Patent Application EP 209,228, both of which are incorporated herein by reference. Lastly, in case the composition is too thin, some thickeners such as gums (xanthan gum and guar gum) and various resins (e.g., polyvinyl alcohol and polyvinyl pyrrolidone) may be suitable for use. Fragrances are also desirable adjuncts in these compositions.

The additives may be present in amounts ranging from 0-30%, more preferably 0-20%, and most preferably 0-10%. In certain cases, some of the individual adjuncts may overlap in other categories. For example, some buffers, such as silicates may be also builders. However, builders are to be avoided in this invention, since even small amounts of either organic or inorganic builders will cause phase instability by reacting with one or more of the ingredients in the inventive liquid detergents. Also, some surface active esters may actually function to a limited extent as surfactants. However, the present invention contemplates each of the adjuncts as providing discrete performance benefits in their various categories.

Experimental

In the experiments disclosed below, Table I discloses the various inventive formulations, and compares against comparative examples in which no alkyl ether carboxylate, and very low amounts of alkyl ether carboxylates are present. Further, if a different material is substituted for the alkyl ether carboxylate, e.g., LAS, noticeable phase instability occurs.

TABLE I

Effect of Alkyl Ether Carboxylate on Liquid Detergent Phase Stability[1]

| Ingredient | Composition A | B | C | D | E |
|---|---|---|---|---|---|
| Neodol 25-9[2] | 38.00 | 38.00 | 38.00 | 38.00 | 38.00 |
| AEOS Anionic[3] | 9.50 | 14.25 | 16.63 | 19.00 | 0.00 |
| AEOC Anionic[4] | 9.50 | 4.75 | 2.38 | 0.00 | 0.00 |
| NaLAS[5] | 0.00 | 0.00 | 0.00 | 0.00 | 19.00 |
| Oleic Acid | 2.00 | 2.00 | 2.00 | 2.00 | 2.00 |
| Ethanol | 4.94 | 4.94 | 4.94 | 4.94 | 4.94 |
| Calcium Chloride | 0.10 | 0.10 | 0.10 | 0.10 | 0.10 |
| Fluorescer | 0.40 | 0.40 | 0.40 | 0.40 | 0.40 |
| Water and minors (dye, fragrance, etc.) | q.s. | q.s. | q.s. | q.s. | q.s. |
| Precipitate present | no | no | yes | yes | yes |

[1]All formulas adjusted with sodium hydroxide solution to pH 7.4. additionally, all ingredients are calculated for 100% active content. Examples stored overnight at 49° C.

[2]Nonionic surfactant ($C_{12}$-$C_{15}$ alcohol with average of nine moles ethylene oxide); Shell Oil Company

[3]AEOS Anionic surfactant (alkyl ether sulfate: sulfate of $C_{12}$-$C_{15}$ alcohol with average of three moles ethylene oxide); Shell Oil Company

[4]AEOC Anionic surfactant (alkyl ether carboxylate: carboxylate of $C_{13}$ alcohol with average of seven moles of ethylene oxide); Sandoz Chemicals. Corrected for 100% active surfactant, 90% of which is carboxylated.

[5]NaLAS = Alkyl benzene sulfonate, sodium salt, $C_{11.5}$, from Pilot Chemical Company Table II discloses the detergency action of the alkyl ether carboxylates. Thus, these materials are not only suitable for use as phase stabilizers, but also enhance or maintain the detergency of the composition.

TABLE II

Detergency Performance of Alkyl Ether Carboxylate[1]

| Surfactant[2] | Soil Removal (% SR) Sebum/ Poly-Cotton | Sebum/ Polyester | Clay/ Cotton |
|---|---|---|---|
| Neodol 25-3S[3] | 76 | 81 | 83 |
| Sandopan DTC[4] | 65 | 78 | 82 |
| Control (Buffer)[5] | 2 | 0 | 69 |

TABLE II-continued

| Surfactant[2] | Detergency Performance of Alkyl Ether Carboxylate[1] Soil Removal (% SR) Sebum/ Poly-Cotton | Sebum/ Polyester | Clay/ Cotton |
|---|---|---|---|
| LSD (0.95, T-test) | 7 | 3 | 7 |

[1]Terg-0-Tometer wash simulation; 12 minute wash at 100 rpm, 5 minute rinse; 100 ppm hardness (3:1 $Ca^{2+}$:$Mg^{2+}$), 0.15 g/l $NaHCO_3$, pH 8.5 ± 0.2. Wash temperature was 100° F. (38° C.).
[2]Surfactants were evaluated at a 0.05% active use level.
[3]Anionic surfactant (alkyl ether sulfate: sulfate of $C_{12-15}$ alcohol with average of three moles ethylene oxide); Shell Oil Company
[4]Anionic surfactant (alkyl ether carboxylate: carboxylate of $C_{13}$ alcohol with average of seven moles ethylene oxide); Sandoz Chemicals
[5]0.15 g/l $NaHCO_3$ Table III discloses the effect of the alkyl ether carboxylates on enzyme stability. Surprisingly, use of these types of phase stabilizers enhances enzyme stability of these composition. Table IV discloses phase stabilities of similar preparations.

TABLE III

Effect of Alkyl Ether Carboxylate on Liquid Detergent Enzyme Stability

| Ingredient | Composition A | B | C | D |
|---|---|---|---|---|
| Neodol 25-9[1] | 28.80 | 28.80 | 28.80 | 28.80 |
| AEOS Anionic[1] | 17.10 | 17.10 | 0.00 | 28.20 |
| AEOC Anionic[1] | 11.40 | 0.00 | 28.20 | 0.00 |
| NaLAS[1] | 0.00 | 11.40 | 0.00 | 0.00 |
| Oleic Acid | 2.00 | 2.00 | 2.00 | 2.00 |
| Ethanol | 4.94 | 4.94 | 4.94 | 4.94 |
| Calcium Chloride | 0.10 | 0.10 | 0.10 | 0.10 |
| Enzyme (Protease)[2] | 0.78 | 0.78 | 0.78 | 0.78 |
| Fluorescer | 0.40 | 0.40 | 0.40 | 0.40 |
| Water and minors (dye, fragrance, etc.) | q.s. | q.s. | q.s. | q.s. |
| % Enzyme Remaining[3] (3 weeks @ 49° C.) | 92 | 60 | 85 | 72 |

[1]See Table 1 for description.
[2]Enzyme is Alcalase, from Novo Industri A/S.
[3]Interpolated values.

Examples A and C, which are exemplary of the invention, had good enzyme stability compared against comparable examples B and D.

TABLE IV

Physical Stability

| Ingredient | Composition E | F | G | H |
|---|---|---|---|---|
| Neodol 25-9[1] | 28.80 | 28.80 | 28.80 | 28.80 |
| AEOS Anionic[1] | 17.10 | 17.10 | 0.00 | 28.20 |
| AEOC Anionic[1] | 11.40 | 0.00 | 28.20 | 0.00 |
| NaLAS[1] | 0.00 | 11.40 | 0.00 | 0.00 |
| Oleic Acid | 2.00 | 2.00 | 2.00 | 2.00 |
| Ethanol | 4.94 | 4.94 | 4.94 | 4.94 |
| Calcium Chloride | 0.10 | 0.10 | 0.10 | 0.10 |
| Enzyme (Protease)[2] | 0.78 | 0.78 | 0.78 | 0.78 |
| Fluorescer | 0.40 | 0.40 | 0.40 | 0.40 |
| Water and minors (dye, fragrance, etc.) | q.s. | q.s. | q.s. | q.s. |
| Phase Stability[3] | Stable | Gel | Stable | Gel |

[1]See Table 1 for description.
[2]Enzyme is Alcalase, from Novo Industri A/S.
[3]Physical Stability: % phase separation or gellation observed at 21° C.

Examples E and G were stable, pourable liquids, versus comparative examples F and H, which were nonpourable gels.

In Table V below, the formulations are compared for minimum levels of phase stabilizer necessary, when certain criteria are varied, such as amount and types of nonionic surfactant:

TABLE V

| Ingredient | I | J | K | L | M | N | O |
|---|---|---|---|---|---|---|---|
| Neodol 25-9[1] | 38.0 | 38.0 | 0.0 | 0.0 | 0.0 | 28.50 | 57.0 |
| Neodol 1-5[2] | 0.0 | 0.0 | 37.58 | 37.58 | 37.58 | 0.0 | 0.0 |
| AEOS[3] | 9.5[3] | 9.5[3] | 18.15[3] | 18.15[3] | 18.15[3] | 0.0 | 0.0 |
| AEOC[4] | 4.75[5] | 2.38[6] | 1.41[7] | 1.41[8] | 0.0 | 38.0[9] | 0.0 |
| Water & misc. | q.s. | q.s. | q.s. | q.s. | q.s. | q.s. | q.s. |
| pH | 7.4 | 7.4 | 7.4 | 7.4 | 7.4 | 7.4 | 7.4 |
| Precipitate? | NO | GEL | NO | NO | GEL | NO | GEL |
| Nonionic/Anionic Ratio | 3.3:1 | 3.6:1 | 1.9:1 | 2:1 | 2:1 | 3.3:1 | 57:0 |

[1]Nonionic surfactant ($C_{12}$-$C_{15}$ alcohol with average of nine moles ethylene oxide); Shell Oil Company.
[2]Nonionic surfactant ($C_{11}$ alcohol with average of five moles ethylene oxide); Shell Oil Company.
[3]AEOS Anionic surfactant (alkyl ether sulfate: sulfate of $C_{12}$-$C_{15}$ alcohol with average of three moles ethylene oxide); Shell Oil Company. All examples are calulated for 100% active content.
[4]AEOC Anionic surfactant (alkyl ether carboxylate: carboxylate of $C_{13}$ alcohol with average of seven moles of ethylene oxide); Sandoz Chemicals.
[5]As 40% carboxylated surfactant, therefore actually 1.9%.
[6]As 40% carboxylated surfactant, therefore actually 0.95%.
[7]As 90% carboxylated surfactant, therefore actually 1.27%.
[8]As 40% carboxylated surfactant, therefore actually 0.564%.
[9]As 40% carboxylated surfactant, therefore actually 15.2%. (22.8% ethoxylated surfactant added back to calculate total nonionic surfactant).

Table V shows that when the nonionic surfactant is $C_{11}$ or less, the minimum amount of alkyl ether carboxylate phase stabilizer is as low as 0.50% (Example L). On the other hand, when the nonionic surfactant is $C_{12}$ or greater, the minimum amount of phase stabilizer exceeds about 1% (Example I). Also, if only alkyl ether sulfate is present as an anionic surfactant, phase instability occurs (Example M), pointing out the criticality of the alkyl ether carboxylate as a phase stabilizer. Finally, excess amounts of nonionic surfactant can form a nonpourable gel (Example O).

The invention is further exemplified in the claims which follow. However, the invention is not limited thereby, and obvious embodiments and equivalents thereof are within the claimed invention.

We claim:

1. A stable liquid aqueous enzyme detergent consisting essentially of, weight percent;

a) 5-65% of an alkoxylated alcohol, nonionic surfactant;
b) 0-30% of an alkyl ether sulfate;
c) 0.5-30% of an alkyl ether carboxylate phase stabilizer;
d) 0.1-5% of an unsaturated $C_{6-18}$ fatty acid foam controller;
e) about 0-25% of a lower alkanol, glycol, or alkylene glycol solvent;
f) about 0.01-5% of a hydrolase enzyme;
g) about 0.01-1% of an enzyme stabilizing water-soluble calcium salt; and
h) the balance, water.

2. The liquid detergent of claim 1 further comprising:

i) an additional phase stabilizer selected from water soluble chlorides, formates, acetates and propionates.

3. The liquid detergent of claim 1 wherein the solvent of (e) further comprises an additional solvent selected from alkylene glycols and glycol ethers.

4. The liquid detergent of claim 1 wherein said hydrolase enzyme is selected from the group consisting of proteases, amylases, cellulases, lipases and mixtures thereof.

5. The liquid detergent of claim 1 further comprising j) a detergent adjunct selected from the group consisting of dyes, pigments, fluorescent whitening agents, anti-redeposition agents, anti-foaming agents, buffers, liquid peroxygen bleaches, bleach activators, thickeners, fragrances, and mixtures thereof.

6. The liquid detergent of claim 1 wherein said alkoxylated nonionic surfactant of (a) is an ethoxylated $C_{10-16}$ alcohol with about 5–20 moles of ethylene oxide per mole of alcohol, with optionally 1–3 moles of propylene oxide per mole of alcohol.

7. The liquid detergent of claim 1 wherein said alkyl ether sulfate of (b) is a $C_{10-16}$ alcohol sulfate with 1–5 moles of ethylene oxide per mole of alcohol.

8. The liquid detergent of claim 1 wherein said alkyl ether carboxylate phase stabilizer of (c) is a $C_{8-18}$ fatty alcohol, which is ethoxylated with 1–20 moles of ethylene oxide per mole of alcohol, or a salt thereof.

9. The liquid detergent of claim 8 wherein said alkyl ether carboxylate of (c) is derived from $C_{10-18}$ fatty alcohol.

10. The liquid detergent of claim 1 wherein said solvent of (e) is ethanol, propanol or a mixture thereof.

11. The liquid detergent of claim 1 wherein said calcium salt of (g) is a soluble salt selected from chloride, acetate, formate and propionate.

12. A phase stable liquid, aqueous enzyme detergent which maintains phase stability at prolonged storage and elevated temperatures consisting essentially of:

a) at least 5% of a nonionic surfactant having an HLB of 10–16 and a pour point less than about 40° C.;

b) at least 1% of a $C_{10-16}$ alkyl ether sulfate, which contains 1–5 moles of ethylene oxide per mole of alcohol;

c) a phase stabilizer which is at least 0.5% of a $C_{8-18}$ alkyl ether carboxylate, which contains 1–20 moles of ethylene oxide per mole of alcohol;

d) at least 0.1%, but not greater than 5%, of an unsaturated $C_{10-16}$ fatty acid or salt thereof, which is used as a foam controller;

e) a mixture of a lower alkanol solvent with a lower glycol, said solvents in a ratio of about 10:1 to 1:10;

f) at least 0.01% of a protease, an amylase, or a mixture thereof;

g) about 0.01–1% of water-soluble calcium ion which effectively stabilizes against enzyme deactivation; and h) the balance, water.

13. The liquid detergent of claim 12 further comprising i) an additional phase stabilizer selected from the group consisting of water soluble chlorides, acetates, formates, propionates, and mixtures thereof.

14. A stable liquid aqueous enzyme-containing detergent which has substantially no phase separation and does not gel at room temperature, said detergent consisting essentially of:

a) 5–65% of an alkoxylated alcohol, nonionic surfactant;

b) 0–30% of an alkyl ether sulfate;

c) an amount of an alkyl ether carboxylate phase stabilizer sufficient to prevent the formation of an insoluble precipitate; the ratio of nonionic surfactant to total anionic surfactants being about 10:1 to 1:1;

d) less than 5% of an unsaturated $C_{6-18}$ fatty acid foam controller;

e) about 0–25% of a lower alkanol, glycol, or alkylene glycol solvent;

f) about 0.01–5% of a hydrolase enzyme;

g) about 0.01–1% of an enzyme stabilizing water-soluble calcium ion; and h) the balance, water and minor additives;

wherein when the alkoxylated alcohol has a chain length of $C_{11}$ or less, the minimum amount of c) phase stabilizer is about 0.5 wt. %; and when the alkoxylated alcohol has a chain length of about $C_{12}$ or greater, the minimum amount of c) phase stabilizer exceeds about 1.0 wt. %.

* * * * *